US006079237A

United States Patent [19]

Hochart

[11] Patent Number: 6,079,237

[45] Date of Patent: Jun. 27, 2000

[54] ELECTRICALLY LOCKED MOTOR VEHICLE DOOR LOCK

[75] Inventor: Jean-Philippe Hochart, Buigny-l'Abbe, France

[73] Assignee: Valeo Securite Habitacle, Creteil, France

[21] Appl. No.: 09/306,892

[22] Filed: May 7, 1999

[30] Foreign Application Priority Data

May 20, 1998 [FR] France ..... 98 06360

[51] Int. Cl.[7] ..... E05C 3/06

[52] U.S. Cl. ..... 70/278.6; 70/278.7; 292/201

[58] Field of Search ..... 70/264, 277, 278.6, 70/278.7, 283.1; 292/201

[56] References Cited

U.S. PATENT DOCUMENTS

| | | | |
|---|---|---|---|
| 4,974,886 | 12/1990 | Kleefeldt et al. | 292/216 X |
| 5,066,054 | 11/1991 | Ingenhoven | 292/201 |
| 5,411,302 | 5/1995 | Shimada | 292/201 |
| 5,494,322 | 2/1996 | Menke | 292/216 |

FOREIGN PATENT DOCUMENTS

| | | |
|---|---|---|
| 195 30 726 A1 | 2/1997 | Germany . |
| 195 45 722 A1 | 4/1997 | Germany . |
| 2 112 443 | 7/1983 | United Kingdom . |

*Primary Examiner*—Lloyd A. Gall
*Attorney, Agent, or Firm*—Pollock, Vande Sande & Amernick

[57] ABSTRACT

Motor vehicle door lock comprising: a latch (1); a pawl (3) which can adopt an "escapement" position; an operating member which, on the one hand, can adopt either an active position in which it acts, during its actuating movement, on the pawl to place it in the "escapement" position, or an inhibited position in which it has no effect on the pawl and, on the other hand, may experience an actuating movement in response to actuation of the door handle; and an electric device (15–24) which responds at least to an unlock signal by moving the operating member from its inhibited position as far as its active position, characterized in that the operating member consists of a set of two links (7, 11) articulated together by a hinge joint (10), of which one (11) of the links comprises a thrust surface **(11*a*) which is positioned in such a way that, in the active position, the thrust surface comes up against and carries along a peg (25) on the pawl (3), during the actuating movement, until the said pawl has been placed in the "escapement" position, and that in the inhibited position, the thrust surface at most comes into contact with the said peg, during the actuating movement so that the operating member has no action on the pawl, and of which the other link (7) is articulated to an opening lever (5), the electric device comprising a lock/unlock lever (15) co-operating with the hinge joint (10) to make it pivot about the articulation (8)**.

21 Claims, 2 Drawing Sheets

ELECTRICALLY LOCKED MOTOR VEHICLE DOOR LOCK

BACKGROUND OF THE INVENTION

The present invention relates to motor vehicle door locks and more particularly to electrically locked locks.

Such locks comprise, as is known, a forked latch intended to interact with a striker, a pawl which normally locks the latch in the closed position, a latch-release mechanism comprising an operating member which experiences an actuating movement in response to actuation of the door handle by the user. The operating member can adopt an active position in which it acts, during its actuating movement, on the pawl in order to place it in the escapement position, and an inhibited position in which, during its actuating movement, it has no effect on the pawl. The lock further comprises an electric device which responds at least to an unlock signal by moving the operating member until it reaches its active position.

Vehicle door lock systems in which the unlock signal is generated by actuation of a lock cylinder are known. In other known systems, this unlock signal is provided by recognition electronics in response to an infrared remote-control or radioelectric remote-control signal produced by the user using an appropriate remote control.

These known systems are not entirely satisfactory because they require the use either of a key or of a remote control, these objects taking up one of the user's hands.

This is why so-called "hands-free vehicle access" systems which do not require the use of a key or of a remote control in order to unlock the lock have been proposed. These systems are equipped with recognition electronics fitted with a radio transmitter and designed to be able to dialog with a radioelectric device incorporated into a wristwatch, a credit card, a badge or the like worn or carried by the user. The recognition electronics do not produce their unlock signal until the correct owner has been identified.

In such systems, the transmission of the unlock signal that operates the electric device, on the one hand, and the actuation of the release mechanism, on the other hand, take place simultaneously.

However, the difference between the relatively long response time of the electric device and the very short response time of the release mechanism is such that the operating member has completed its actuating movement even though it is not yet in the active position, which means that the user's first action on the door handle does not cause the door to open and that the said user has to operate the door handle again in order to open it.

This need to operate the door handle twice is a drawback that the present invention sets out to eliminate.

The subject of the present invention is therefore a motor vehicle door lock comprising: a forked latch intended to interact with a striker; a pawl which normally locks the latch in the closed position and which can adopt an "escapement" position in which it no longer acts on the said latch; a latch-release mechanism comprising an operating member, which, on the one hand, can adopt either an active position in which it acts, during its actuating movement, on the pawl to place it in the "escapement" position, or an inhibited position in which, during its actuating movement, it has no effect on the pawl and, on the other hand, may experience an actuating movement in response to actuation of the door handle by the user; and an electric device which responds at least to an unlock signal by moving the operating member from its inhibited position until it reaches its active position, characterized in that the operating member consists of a set of two links articulated together by a hinge joint, of which one of the links, known as the first link, comprises a thrust surface which is positioned in such a way that when the operating member is in the active position, the thrust surface comes up against and carries along a peg provided on the pawl, during the actuating movement of the operating member, until the said pawl has been placed in the "escapement" position, and that when the operating member is in the inhibited position, the thrust surface at most comes into contact with the said peg, during the actuating movement of the operating member so that the operating member has no action on the pawl, and of which the other link, known as the second link, is articulated to a lever for opening the lock from the outside which lever is intended to move the operating member in its actuating movement in response to actuation of the door handle by the user, and in that the aforementioned electric device comprises a lock/unlock lever cooperating with the hinge joint to make it pivot about the articulation between the second link and the lever for opening from the outside, so as to increase the distance separating the peg of the pawl from the hinge joint, therefore from the thrust surface when the operating member is moved into its inhibited position. By providing a hinge joint operating member, it is possible to reduce the number of moving parts in the lock, which makes it possible to produce a more compact lock.

In one particular embodiment, the lock/unlock lever at one end has a fork between the branches of which the hinge pin of the hinge joint is housed so that it can slide so as to allow the actuating movement of the operating member, both in its inhibited position and in its active position.

According to another feature, the lock comprises an opening catch-up means which, when the unlock signal is transmitted more or less at the end of the actuating travel of the operating member, brings the pawl into the "escapement" position, the opening catch-up means being produced as follows: since part of the thrust surface and the adjacent part of the surface of the periphery of the peg of the pawl are shaped and positioned in such a way as respectively to form a fulcrum and a pivot cooperating with one another when the operating member is more or less in the end-of-actuating-movement position, the moving of the operating member by the lock/unlock lever as far as the active position causes the peg of the pawl to be carried along, by virtue of the action of the fulcrum on the pivot, until the said pawl has been placed in the "escapement" position.

Thus, by virtue of the invention, the door can be opened by operating the door handle just once, and this is true despite the difference there is between the response time of the release mechanism, which is very fast, and that of the electric unlock device, which is slower.

According to yet another feature, the electric device comprises an electric motor for driving a movement transmission mechanism which acts on the opposite end of the lock/unlock lever to the end which cooperates with the hinge joint, this lever being articulated to a fixed pin of the lock at a point which is off-centred on the opposite side to the end co-operating with the hinge joint so as to increase the lever arm on the hinge joint side. Thus the force to be supplied by the electric motor to move the hinge joint is reduced, which makes it possible to use an electric motor that is less powerful than the one used in conventional locks.

Advantageously, in the active position the two links of the operating member are more or less aligned in the direction of the peg of the pawl and the lock/unlock lever cooperates with the hinge joint in such a way as to allow it to be moved in the said direction during the actuating movement of the operating member.

Conversely, it is possible to ensure that, in the inhibited position, the two links of the operating member form an obtuse angle between them, the hinge joint (10) being offset to the side with respect to the line passing through the peg of the pawl and the articulation between the second link and the lever for opening from the outside.

According to another feature, the first link is guided, during the actuating movement of the operating member, both in its active position and in its inhibited position, in such a way as to keep the thrust surface more or less in the direction of the peg of the pawl.

In another alternative form, the first link is guided, during the actuating movement of the operating member, both in its active position and in its inhibited position, in such a way as to keep the thrust surface aligned with the peg of the pawl and with the articulation between the second link and the lever for opening from the outside.

Advantageously, the hinge joint is a bistable articulation with two stable angular positions corresponding to the inhibited and to the active position of the operating member.

It is advantageous to ensure that the unlock signal is transmitted by recognition electronics which are electrically powered only when the user exerts action on the door handle, the said electronics then identifying an authorized user by a radioelectric transmission exchanged in accordance with an appropriate protocol with an electronic element worn or carried by the user; this avoids needless consumption of the electrical power. This can be obtained using a microswitch (or any other control system) which is normally open, closure of which is brought about by the opening action on the door handle, this operating system completing the recognition-electronics power-supply circuit.

Other features and advantages of the invention will become clear from reading the description, given hereinbelow by way of non-limiting indication, of two preferred embodiments, the description being given with reference to the appended drawing.

DETAILED DESCRIPTION OF PREFERRED EMBODIMENT

Figure 3:
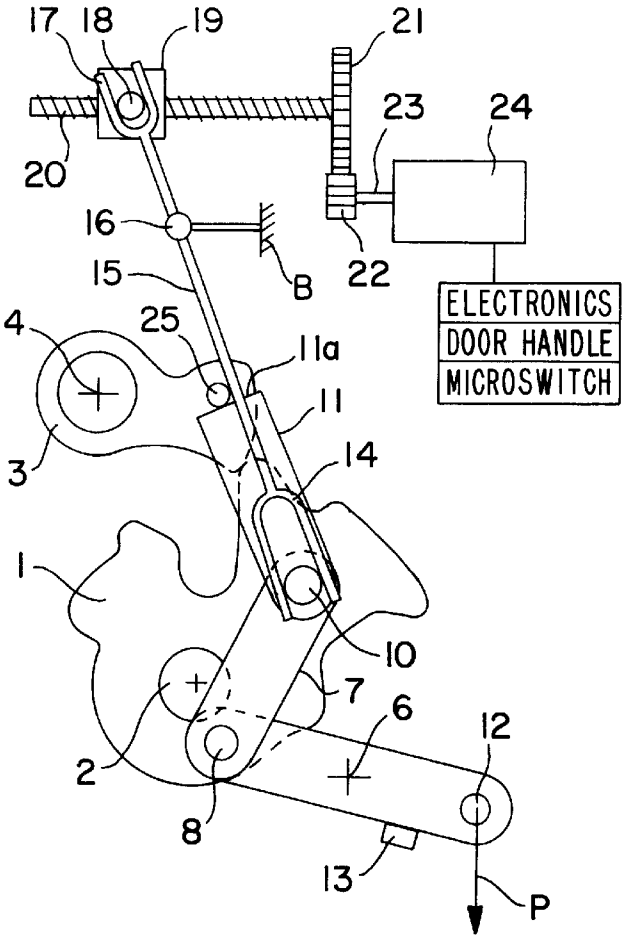
FIG. 3 depicts a view similar to FIG. 1, showing the operating member in the inhibited position and the actuating leper in the actuated position.
Figure 2:
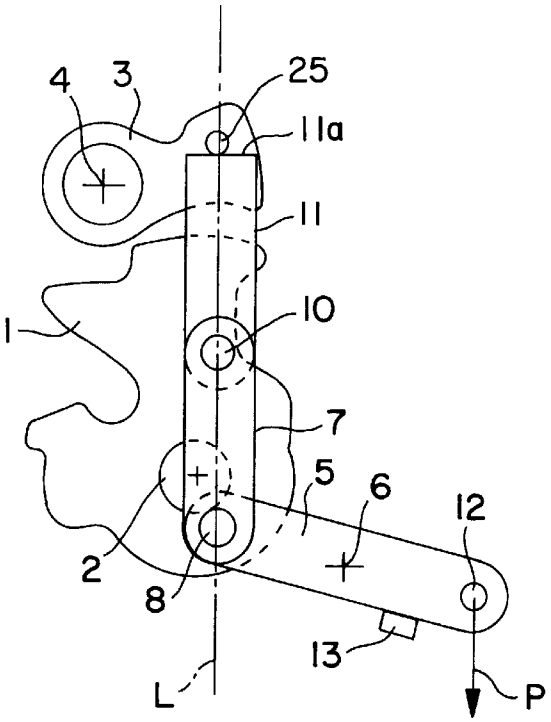
FIG. 2 depicts a view similar to FIG. 1, showing the operating member in the active position and the actuating lever in the actuated position.
Figure 1:
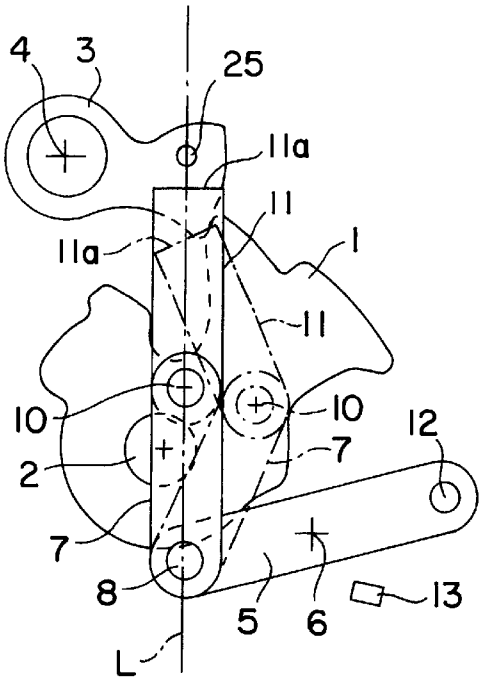
FIG. 1 depicts a partial elevation of a lock according to one embodiment of the invention, the operating member being in the active position, the actuating lever connected to the door handle being in a position of rest.

According to the first embodiment, the lock depicted in FIGS. 1 to 3 comprises a housing (not depicted), a forked latch 1 articulated to the housing at 2, and a pawl 3 articulated to the housing at 4. The latch 1 is intended to interact, in the known way, with a striker, not depicted. The pawl 3, as is known, is associated with elastic means, not depicted, urging it toward a position that locks the latch 1 in the closed position, as depicted in FIGS. 1 and 3, and can be placed in an "escapement" position, against the action of the said elastic means, by a latch-release mechanism controlled by a door handle (or hinged lever), not depicted.

The latch-release mechanism comprises an actuating lever 5, also known as the lever for opening from the outside, articulated to the housing at 6, a link 7 articulated at 8 by its lower end to the left-hand end of the lever 5, and at 10 by its upper end to the lower end of another link 11. The hinge pin 10 constitutes a mobile hinge between the two links 7 and 11 which together form a hinge-jointed member for operating the pawl 3. The two links 7 and 11 extend in a more or less vertical direction in FIGS. 1 and 2.

The lever 5 is articulated at 12 by its right-hand end to an opening linkage, not depicted, which is connected to a door handle. The lever 5 is associated with elastic means urging it toward its position of rest in which it has been depicted in FIG. 1. The lever 5 is intended to come up against a projection 13 provided on the lock housing, to limit the pivoting of the lever 5 in its travel for actuating the operating member.

The hinge pin of the hinge joint 10 is housed so that it can slide between the branches of a fork 14, depicted schematically and only in FIG. 3, forming part of an electric device for locking/unlocking the lock. The fork 14 is provided at one end of a lever 15 which is articulated at 16 to a fixed hinge pin on the housing B and which at its opposite end has another fork 17, between the branches of which a peg 18 which projects from a nut 19 is housed. The nut 19 is able to effect a translational movement longitudinally along an endless screw 20 when it is turned, the said screw 20 rotating as one with a toothed cog 21 which meshes tangentially with a gearwheel 22 which is in turn driven by the drive shaft 23 of an electric motor 24. The collection of elements 14 to 24 constitutes the electric lock/unlock device. The lock/unlock lever 15 may adopt two fixed positions with respect to the lock housing. A so-called locked position for the lever 15 is depicted in FIG. 3 and corresponds to a so-called inhibited angular position of the hinge joint 10 and therefore of the operating member. The other position of the lever 15, the so-called unlocked position, is not depicted, but corresponds to the so-called active angular position of the hinge joint 10 and therefore the operating member, which is depicted in FIGS. 1 and 2. The motor 24 of the electric actuator is designed to respond to a lock signal and to an unlock signal causing the nut 19 to translate axially along the endless screw 20, so as to move the lever 15 about its hinge pin 16 between its locked position (and consequently move the hinge joint 10 into its inhibited position) and into its unlocked position (and consequently move the hinge joint 10 into its active position).

The unlock signal may be transmitted by recognition electronics, not depicted, forming part of a "hands-free access" system known per se requiring the use of neither key nor remote control in order to unlock the lock. In this system, the recognition electronics are equipped with a radio transmitter and are designed to be able to dialog with a radioelectric device incorporated into a wristwatch or a card or a badge worn or carried by the user. The recognition electronics do not produce their unlock signal until the correct owner has been identified.

For each fixed position of the lock/unlock lever 15, when the actuating lever 5 has been pivoted in the direction of the arrow P in FIGS. 2 and 3, by actuating the door handle, the operating member experiences a so-called actuating movement, directed upward, during which the link 11 may act or not act on the pawl 3 in order to place it in the "escapement" position (the position depicted in FIG. 2), as will be explained later.

At its upper end, the link 11 has a thrust surface 11*a* which is more or less flat and at right angles to the vertical direction in FIGS. 1 and 2. On its face facing the link 11, the pawl 3 has a peg 25 projecting toward the said link 11.

The elements 5 to 13 constituting the latch-release mechanism and the peg 25 of the pawl 3 are together arranged in such a way that when the operating member is in the active angular position (FIGS. 1 and 2), the link 11 can, during its actuating movement, act on the pawl 3, by the action of the flat thrust surface 11*a* of the peg 25, to place the pawl 3 in the escapement position and that, when the operating member is in the inhibited angular position, the link 11 has no effect on the pawl 3 in its actuating movement, the thrust surface 11*a* then remaining, throughout the actuating movement, more or less some distance from the peg 25 and just coming into contact with the peg 25 at the end of the actuating travel, in the position illustrated in FIG. 3. The inhibited angular position of the operating member, when the lever 5 is in the position of rest, is depicted in chain line in FIG. 1. In this position, it can be seen that the hinge joint 10 has been shifted angularly to the right, by pivoting about the articulation 8, under the action of the fork 14 of the lock/unlock lever 15, the link 7 being inclined to the right with respect to the vertical direction, while the link 11 is inclined in the opposite direction with respect to the vertical so as to keep the thrust surface 11*a* more or less aligned with the line L passing through the peg 25 and the articulation 8. In the position illustrated in chain line in FIG. 1, the two links 7 and 11 of the operating member together form an essentially obtuse angle, but as an alternative it could be ensured that they form an acute angle, without departing from the scope of the invention.

In the position illustrated in FIG. 3, the lever 5 is in the actuated position, and the member that operates the hinge joint more or less retains the cranked shape visible in chain line in FIG. 1. This is because as the lever 5 pivots about its axis 6, the articulation 8 is raised and moves the link 7 and therefore the hinge joint 10 upward, because the hinge pin of the hinge joint 10 cannot escape laterally and is forced to move upward between the branches of the fork 14 of the lever 15, which also causes the link 11 to rise and brings its thrust surface 11*a* just into contact with the peg 25 of the pawl 3. Thus, when the operating member is more or less at the end of its actuating movement, as depicted in FIG. 3, and the hinge joint 10 is carried along by the lever 15 toward its active position, the thrust surface 11*a* acts as a fulcrum on the peg 25 which constitutes a pivot about which the thrust surface 11*a* moves and this surface at the same time lifts the peg 25 toward the position illustrated in FIG. 2. That part of the surface of the periphery of the peg 25 which is adjacent to the thrust surface 11*a* is rounded so as to facilitate the pivoting of the thrust surface 11*a* on the peg 25.

Although this has not been depicted in FIGS. 1 to 3, the upper end portion of the link 11 is housed so that it can slide in a guide piece which is itself articulated to a pin fixed on the housing, to keep the thrust surface 11*a* aligned with the line L, while at the same time allowing the link 11 to incline, as illustrated in broken line in FIG. 1.

Figure 4A:
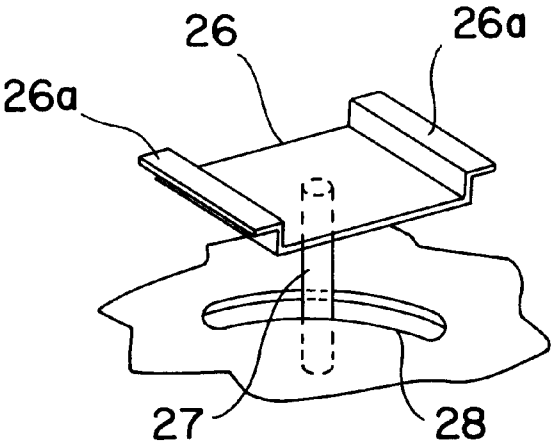
FIG. 4A is a view in perspective showing the arrangement of the guide piece illustrated in FIG. 4.
Figure 4:
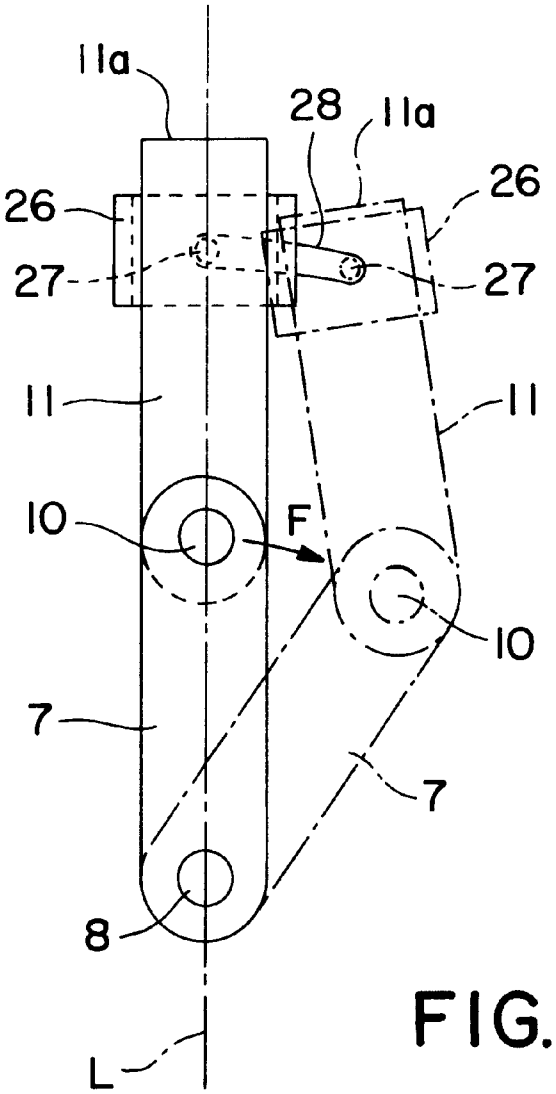
FIG. 4 is a partial view of FIG. 1, but depicting another embodiment of the invention.

In the other embodiment depicted in FIGS. 4 and 4A, the lock of the invention differs only by the fact that the guide piece 26 for the link 11 is articulated to a pin 27 which is housed so that it can slide in a slot 28 in the housing, instead of being fixed with respect to this housing. Thus, as can be seen in FIG. 4, when the operating member is moved into its inhibited position depicted in chain line, the thrust surface 11*a* of the link 11 moves sideways to the right with respect to the line L, to keep the said thrust surface 11*a* pointing toward the peg 25. In other words, the thrust surface 11*a* is kept at right angles to the line passing through the hinge joint 10 and the peg 25. Thus, when the operating member is moved into its inhibited position, the hinge joint 10 is moved angularly in the direction of the arrow F about the articulation 8, and the link 11 becomes inclined to the left, while at the same time sliding downward inside the guide piece 26 which, itself, effects a translational movement to the right along the slot 28.

The guide piece 26 may be in the form of a flat plate, the lateral edges 26*a* of which are stamped in such a way as to form lateral guide rails for the link 11.

The way in which the lock depicted in FIGS. 1 to 3 works is as follows.

FIG. 1 depicts the lock in a starting position in which the operating member is in the active position (lock unlocked) and the lever 5 is in the position of rest. If, under these conditions, action is exerted on the door handle, the lever 5 is tilted in the direction of the arrow P, as can be seen in FIG. 2, causing an upward movement of the hinge pin 8 and therefore of the set of two links 7 and 11 which, finding themselves in an active position, will act, during their movement, via the thrust surface 11*a*, on the peg 25 to cause the pawl 3 to pivot in the counterclockwise direction until it reaches its escapement position. The links 7 and 11 will have undergone a vertical translation, which translation is allowed by the lever 15 because the hinge joint 10 will have slid vertically between the branches of the fork 14.

A broken line has been used in FIG. 1 to depict another starting position of the lock, in which position the operating member is in the inhibited position (lock locked) and the lever 5 in the position of rest. If, under these conditions, action is exerted on the door handle and, at the same time, the electric motor 24 is activated by emitting an unlock signal produced, for example, by bringing a badge closer to the lock, this will first of all result in the situation depicted in FIG. 3: action on the door handle will, like in the previous instance, cause an upward movement of the hinge pin 8 and therefore of the set of two links 7 and 11, but the tilting of the hinge joint 10 from its inhibited starting position into its active position will not occur until later because the electric device is slower than the release mechanism. Thus, until the end of the actuating movement of the operating lever, the latter will remain in the inhibited position, which means that the thrust surface 11*a* will just come into contact with the peg 25 at the end of the actuating movement travel.

When the electric device begins to act by pulling the hinge joint 10 to the left, in FIG. 3, using the fulcrum embodied by the thrust surface 11*a* against the rounded shape of the peg 25 acting as a pivot, the peg 25 will not be blocked against the link 11 but on the contrary the peg 25 will move upward, consequently causing the pawl 3 to pivot in the counterclockwise direction until the said pawl is brought into its escapement position, as depicted in FIG. 2, in which the pawl no longer acts on the forked latch 1, thus allowing the door to be opened.

As visible in FIG. 3, that portion of the lever 15 that runs between the hinge pin 16 and the fork 14 is distinctly longer than that portion of the lever 15 that runs between the hinge pin 16 and the fork 17, which means that the lever arm on the same side as the hinge joint 10 is far greater, which makes it possible to reduce the force to be supplied by the electric motor 24. In effect, the angular travel of the hinge joint 10 is reduced compared with that of the fork 17.

Thus, by virtue of the invention, the door handle needs to be actuated just once in order to open this door, and this is true despite the difference in response times that there is between the response time of the release mechanism, which is very fast, and that of the electric locking/unlocking device, which is slower.

It is advantageous to envisage that the recognition electronics are not electrically powered until the user exerts an action on the handle in order to open the door, this being in order to avoid needless consumption of electrical power. This can be obtained using a microswitch (or any other operating system), not depicted, which is normally open, the closure of which is brought about by action on the door handle, this microswitch completing a recognition-electronics power-supply circuit, not depicted.

What is claimed is:

1. Motor vehicle door lock comprising: a forked latch (1) intended to interact with a striker; a pawl (3) which normally locks the latch in the closed position and which can adopt an "escapement" position in which it no longer acts on the said latch; a latch-release mechanism comprising an operating member (7, 10, 11) which, on the one hand, can adopt either an active position in which it acts, during its actuating movement, on the pawl to place it in the "escapement" position, or an inhibited position in which, during its actuating movement, it has no effect on the pawl and, on the other hand, may experience an actuating movement in response to actuation of a door handle by the user; and an electric device (15–24) which responds at least to an unlock signal by moving the operating member from its inhibited position until it reaches its active position, characterized in that the operating member comprises a set of two links (7, 11) articulated together by a hinge joint (10), of which one (11) of the links, known as the first link, comprises a thrust surface **(11*a*) which is positioned in such a way that when the operating member is in the active position, the thrust surface comes up against and carries along a peg (25) provided on the pawl (3), during the actuating movement of the operating member, until the said pawl has been placed in the "escapement" position, and that when the operating member is in the inhibited position, the thrust surface at most comes into contact with the said peg, during the actuating movement of the operating member so that the operating member has no action on the pawl, and of which the other link (7), known as the second link, is articulated to a lever (5) for opening the lock from the outside which lever is intended to move the operating member in its actuating movement in response to actuation of the door handle by the user, and in that the aforementioned electric device comprises a lock/unlock lever (15) co-operating with the hinge joint (10) to make it pivot about the articulation (8) between the second link (7) and the lever (5) for opening from the outside, so as to increase the distance separating the peg (25) of the pawl from the hinge joint, therefore from the thrust surface (11*a*)** when the operating member is moved into its inhibited position.

2. Lock according to claim 1, characterized in that the lock/unlock lever (15) at one end has a fork (14) between the branches of which the hinge pin of the hinge joint (10) is housed so that it can slide so as to allow the actuating movement of the operating member, both in its inhibited position and in its active position.

3. Lock according to claim 1, characterized in that it comprises an opening catch-up means which, when the unlock signal is transmitted generally at the end of the actuating travel of the operating member, brings the pawl (3) into the "escapement" position, the opening catch-up means being produced as follows: since part of the thrust surface **(11*a*) and the adjacent part of the surface of the periphery of the peg (25) of the pawl are shaped and positioned in such a way as respectively to form a fulcrum and a pivot co-operating with one another when the operating member is generally in the end-of-actuating-movement position, the moving of the operating member by the lock/unlock lever (15) as far as the active position causes the peg (25)** of the pawl to be carried along, by virtue of the action of the fulcrum on the pivot, until the said pawl has been placed in the "escapement" position.

4. Lock according to claim 1, characterized in that the electric device comprises an electric motor (24) for driving a movement transmission mechanism (18–23) which acts on the opposite end (17) of the lock/unlock lever (15) to the end (14) which cooperates with the hinge joint, this lever being articulated to a fixed pin (16) of the lock at a point which is off-centered on the opposite side to the end co-operating with the hinge joint so as to increase the lever arm on the hinge joint side.

5. Lock according to claim 1, characterized in that in the active position the two links (7, 11) of the operating member are generally aligned in the direction of the peg (25) of the pawl (3) and the lock/unlock lever (15) cooperates with the hinge joint (10) in such a way as to allow it to be moved in the said direction during the actuating movement of the operating member.

6. Lock according to claim 1, characterized in that in the inhibited position, the two links (7, 11) of the operating member form an obtuse angle between them, the hinge joint (10) being offset to the side with respect to the line (L) passing through the peg (25) of the pawl (3) and the articulation (8) between the second link (7) and the lever (5) for opening from the outside.

7. Lock according to claim 1, characterized in that the first link (11) is guided, during the actuating movement of the operating member, both in its active position and in its inhibited position, in such a way as to keep the thrust surface **(11*a*) generally in the direction of the peg (25) of the pawl (3)**.

8. Lock according to claim 1, characterized in that the first link (11) is guided, during the actuating movement of the operating member, both in its active position and in its inhibited position, in such a way as to keep the thrust surface **(11*a*) aligned with the peg (25) of the pawl (3) and with the articulation (8) between the second link (7) and the lever (5)** for opening from the outside.

9. Lock according to one of claim 1, characterized in that the hinge joint (10) is a bistable articulation with two stable angular positions corresponding to the inhibited and to the active position of the operating member.

10. Lock according to claim 1, characterized in that the unlock signal is transmitted by recognition electronics which are electrically powered only when the user exerts action on the door handle, the said electronics then identifying an authorized user by a radioelectric transmission exchanged in accordance with an appropriate protocol with an electronic element worn or carried by the user.

11. Lock according to claim 10, characterized in that the recognition electronics are powered via a microswitch which is normally open, closure of which is brought about by the opening action on the door handle, this operating system completing a recognition-electronics power-supply circuit.

12. Lock according to claim 2, characterized in that it comprises an opening catch-up means which, when the unlock signal is transmitted generally at the end of the actuating travel of the operating member, brings the pawl into the "escapement" position, the opening, catch-up means being produced as follows: since part of the thrust surface and the adjacent part of the surface of the periphery of the peg of the pawl are shaped and positioned in such a way as respectively to form a fulcrum and a pivot cooperating with one another when the operating member is generally in the end-of-actuating-movement position, the moving of the operating member by the lock/unlock lever as far as the active position causes the peg of the pawl to be carried along, by virtue of the action of the fulcrum on the pivot, until the said pawl has been placed in the "escapement" position.

13. Lock according to claim 2, characterized in that the electric device comprises an electric motor for driving a movement transmission mechanism which acts on the opposite end of the lock/unlock lever to the end which cooperates with the hinge joint, this level being articulated to a fixed pin of the lock at a point which is off-centered on the opposite side to the end cooperating with the hinge joint so as to increase the lever arm on the hinge joint side.

14. Lock according to claim 3, characterized in that the electric device comprises an electric motor for driving a movement transmission mechanism which acts on the opposite end of the lock/unlock lever to the end which cooperates with the hinge joint, this lever being articulated to a fixed pin of the lock at a point which is off-centered on the opposite side to the end cooperating with the hinge joint so as to increase the lever arm on the hinge joint side.

15. Lock according to claim 2, characterized in that in the active position the two links of the operating member are generally aligned in the direction of the peg of the pawl and the lock/unlock lever cooperates with the hinge joint in such a way as to allow it to be moved in the said direction during the actuating movement of the operating member.

16. Lock according to claim 3, characterized in that in the active position the two links of the operating member are generally aligned in the direction of the peg of the pawl and the lock/unlock lever cooperates with the hinge joint in such a way as to allow it to he moved in the said direction during the actuating movement of the operating member.

17. Lock according to claim 4, characterized in that in the active position the two links of the operating member are generally aligned in the direction of the peg of the pawl and the lock/unlock lever cooperates with the hinge joint in such a way as to allow it to be moved in the said direction during the actuating movement of the operating member.

18. Lock according to claim 2, characterized in that in the inhibited position, the two links of the operating member form an obtuse angle between them, the hinge joint being offset to the side with respect to the line passing through the peg of the pawl and the articulation between the second link and the lever for opening from the outside.

19. Lock according to claim 3, characterized in that in the inhibited position, the two links of the operating member form an obtuse angle between them, the hinge joint being offset to the side with respect to the line passing through the peg of the pawl and the articulation between the second link and the lever for opening from the outside.

20. Lock according to claim 4, characterized in that in the inhibited position, the two links of the operating member form an obtuse angle between them, the hinge joint being offset to the side with respect to the line passing through the peg of the pawl and the articulation between the second link and the lever for opening from the outside.

21. Lock according to claim 5, characterized in that in the inhibited position, the two links of the operating member form an obtuse angle between them, the hinge joint being offset to the side with respect to the line passing through the peg of the pawl and the articulation between the second link and the lever for opening from the outside.

* * * * *